US009213259B2

(12) United States Patent
Shigehiro

(10) Patent No.: US 9,213,259 B2
(45) Date of Patent: Dec. 15, 2015

(54) DEVELOPING DEVICE AND IMAGE FORMING APPARATUS

(71) Applicant: CANON KABUSHIKI KAISHA, Tokyo (JP)

(72) Inventor: Koji Shigehiro, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/597,306

(22) Filed: Jan. 15, 2015

(65) Prior Publication Data

US 2015/0220017 A1 Aug. 6, 2015

(30) Foreign Application Priority Data

Feb. 4, 2014 (JP) ..... 2014-019312

(51) Int. Cl.
*G03G 15/08* (2006.01)
*G03G 15/09* (2006.01)

(52) U.S. Cl.
CPC ..... *G03G 15/0812* (2013.01); *G03G 15/09* (2013.01)

(58) Field of Classification Search
CPC ..... G03G 15/0812; G03G 15/09
See application file for complete search history.

(56) References Cited

U.S. PATENT DOCUMENTS

2007/0110484 A1* 5/2007 Yamada et al. ..... 399/286

FOREIGN PATENT DOCUMENTS

JP 2010-139922 A 6/2010
JP 5282553 B2 9/2013

* cited by examiner

*Primary Examiner* — G. M. Hyder
(74) *Attorney, Agent, or Firm* — Fitzpatrick, Cella, Harper & Scinto

(57) ABSTRACT

A developing device includes a developer bearing member which bears a two-component developer including a toner and carrier, a magnet member disposed inside the developer bearing member, and a developer regulating member which regulates a layer thickness of the developer borne on the developer bearing member. The developer regulating member is made of magnetic material and is fixed at both end portions in a longitudinal direction. Grooves are formed on a surface of the developer bearing member, and a developer conveying force of the grooves at a central portion of the developer bearing member in the longitudinal direction is larger than a developer conveying force of the grooves at an end portion of the developer bearing member in the longitudinal direction.

24 Claims, 12 Drawing Sheets

DEVELOPING DEVICE AND IMAGE FORMING APPARATUS

BACKGROUND OF THE INVENTION

1. Field of the Invention

The present invention relates to an image forming apparatus such as a copying machine, a printer and a facsimile and a developing device used in these apparatuses.

2. Description of the Related Art

In a conventional developing device, a developing sleeve is rotatably supported at both longitudinal ends. Therefore, when the developing sleeve is deflected, S-D gap (a distance between the developing sleeve and a photosensitive drum) in the longitudinal center of the developing sleeve becomes wider. Thus, the image density at end portions in the longitudinal direction of the photosensitive drum is sometimes lowered.

In Japanese Patent Laid-Open No. 2010-139922, the depth of the concave portion of an uneven shape of the developing sleeve is deepened more as it nears both ends in the longitudinal direction. Thus, an amount of toner carried on both longitudinal end portions is increased, thereby suppressing a decrease in image density at both end portions in the longitudinal direction.

However, in the developing device using a two-component developing system, a developer regulating member is provided in a position close to the cut-pole of the magnet roll (magnetic member) in the photosensitive drum. The developer regulating member is often a plate-shaped blade. In addition, the developer regulating member is not firmly supported because of saving space and saving number of parts, thereby the deflection is more likely to occur. Accordingly, a simple developer regulating member with a magnetic material is attracted to the cut-pole.

Because the developer regulating member becomes closer to the development sleeve as it becomes farther from the supporting portion, S-B-gap (a distance between the developing sleeve and the developer regulating member) is narrowed at the position far from the supporting portion. Thus, M/S (developer weight per unit area) in the longitudinal center of the developer sleeve (developer bearing member) is lowered and the amount of toner which can be developed on the photosensitive drum is lowered.

SUMMARY OF THE INVENTION

An object of the present invention is to provide a developing device or an image forming apparatus which is able to suppress density unevenness of an output image even if a gap between the developing sleeve and the developer regulating member becomes narrower because the developer regulating member is attracted by a magnet member.

In order to resolve the above problem, a representative configuration of the present invention of a developing device or an image forming apparatus comprising: a developer bearing member which bears a two-component developer including a toner and carrier; a magnet member disposed inside the developer bearing member, the magnet member making the developer bearing member bear the two-component developer on the developer bearing member by magnetic force; and a developer regulating member which regulates a layer thickness of the developer borne on the developer bearing member, the developer regulating member being made of magnetic material, the developer regulating member being fixed at both end portions in a longitudinal direction, wherein grooves are formed on a surface of the developer bearing member, and a developer conveying force of the grooves at a central portion of the developer bearing member in the longitudinal direction is larger than a developer conveying force of the grooves at an end portion of the developer bearing member in the longitudinal direction.

Further features of the present invention will become apparent from the following description of exemplary embodiments with reference to the attached drawings.

DESCRIPTION OF THE EMBODIMENTS

First Embodiment

Figure 1:
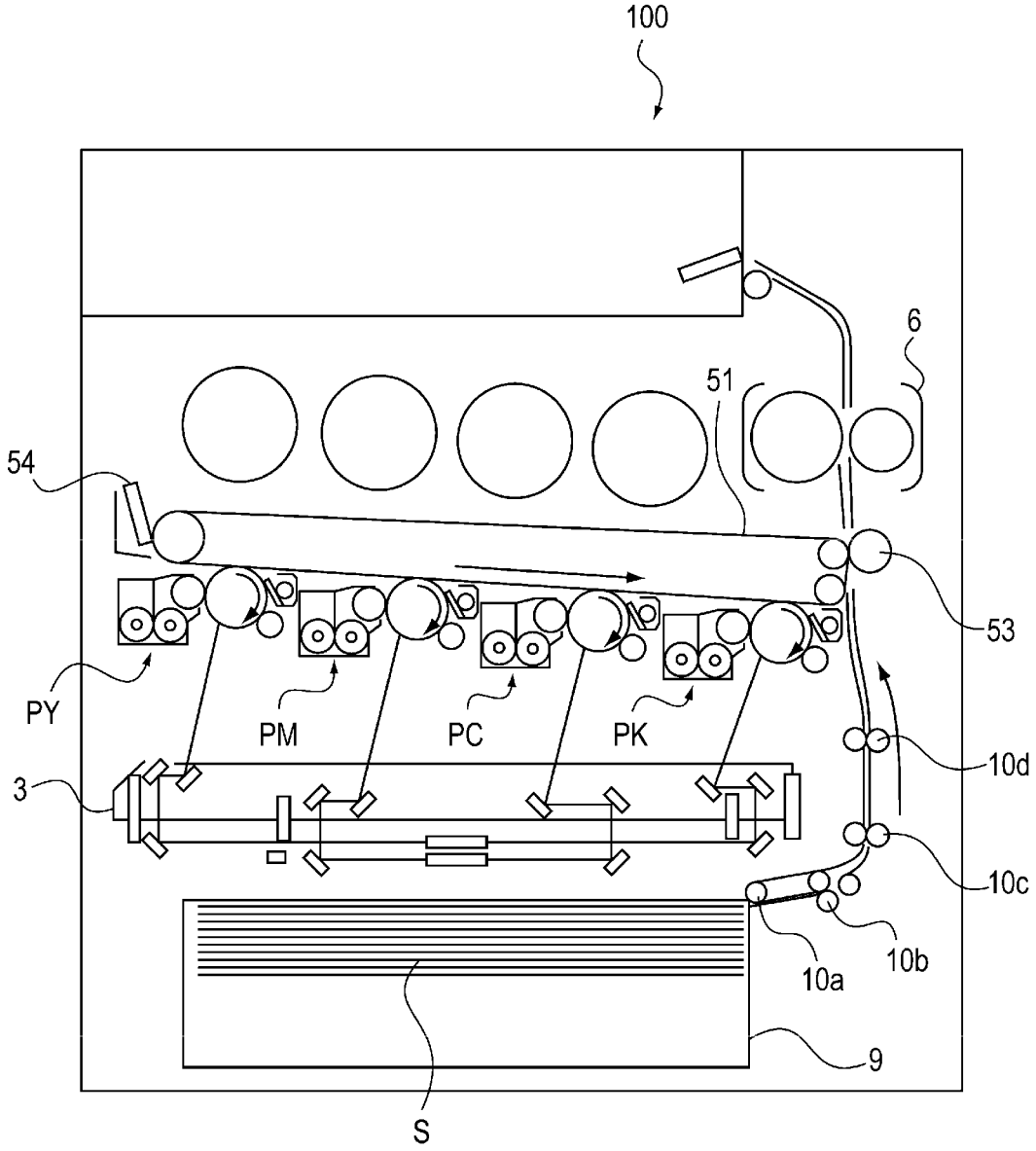
FIG. 1 is schematic diagram of an image forming apparatus according to the first embodiment of the present invention.
Figure 2:
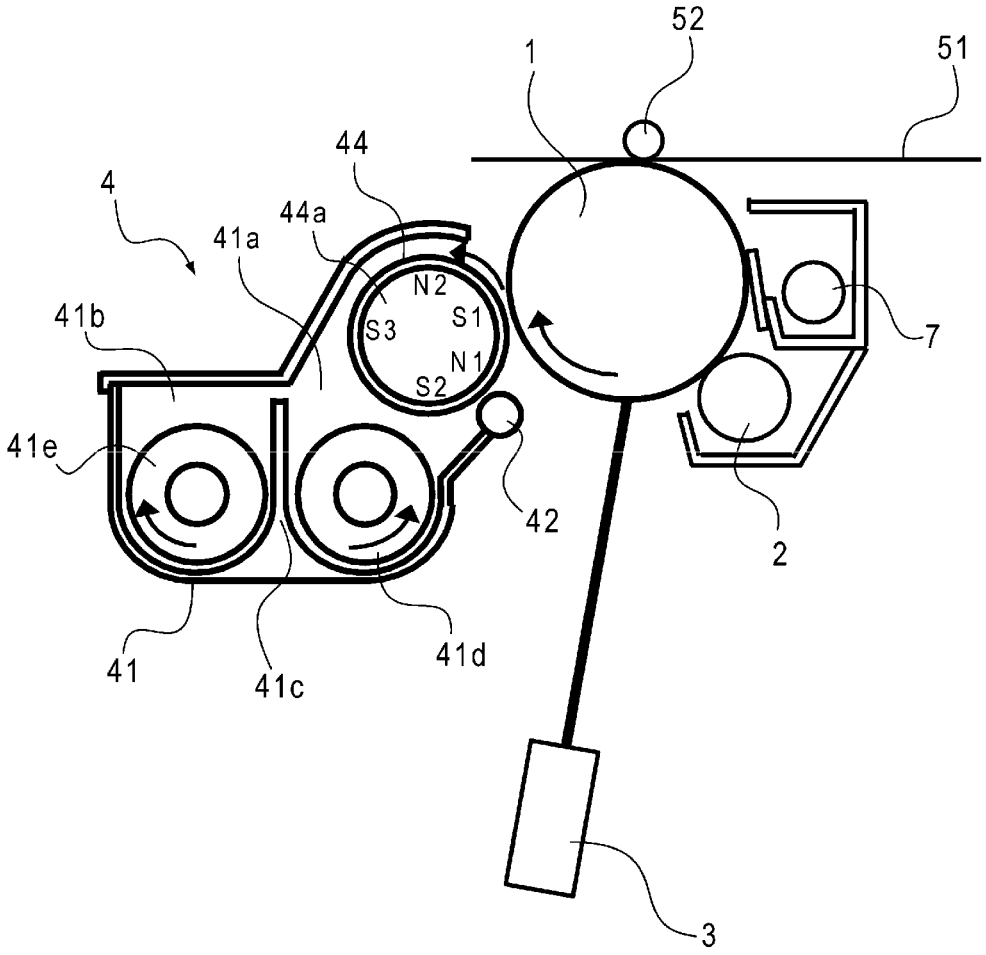
FIG. 2 is a schematic diagram of an image forming unit of the first embodiment of the present invention.

A first embodiment of a developing device and an image forming apparatus according to the present invention will be described with reference to FIGS. 1-6B. FIG. 1 is a diagram showing a structure of an image forming apparatus 100 according to this embodiment. FIG. 2 is a diagram showing a structure of an image forming unit of the image forming apparatus 100 according to this embodiment.

As shown in FIGS. 1 and 2, the image forming apparatus 100 of the present embodiment has the image forming units PY, PM, PC and PK of yellow (Y), magenta (M), cyan (C) and black (K), respectively.

In the image forming units PY, PM, PC and PK, the photosensitive drum (image bearing member) 1 charged by the charging roller 2 is exposed by the exposure device 3 in response to an image information signal, thereby, an electrostatic latent image is formed on the photosensitive drum 1. The formed electrostatic latent image is developed as a toner image of each color by the developing device 4. Each color toner image is primarily transferred to the intermediate transfer belt 51 in an overlapping manner by the primary transfer member 52 at the primary transfer portion (primary transfer nip) T1 where the intermediate transfer belt 51 is in contact with the photosensitive drum 1. Residual toner remaining on the photosensitive drum 1 after the primary transfer is collected by the cleaning device 7.

On the other hand, the sheet S stored in the cassette 9 is conveyed by the pickup roller 10*a*, conveying rollers 10*b*, 10*c* and the registration roller 10*d* to the secondary transfer portion (nip) T2 where the intermediate transfer belt 51 is in contact with the secondary transfer member 53. The toner image on the intermediate transfer belt 51 is secondarily transferred to the sheet S at the secondary transfer portion (nip) T2 and the sheet S is fixed by the fixing device 6 by means of heat and pressure. Thereafter, the sheet S is discharged outside the main body of the image forming apparatus 100. Residual toner remaining on the intermediate transfer belt 51 after the secondary transfer is collected by the intermediate transfer member cleaner 54.

Figure 3:
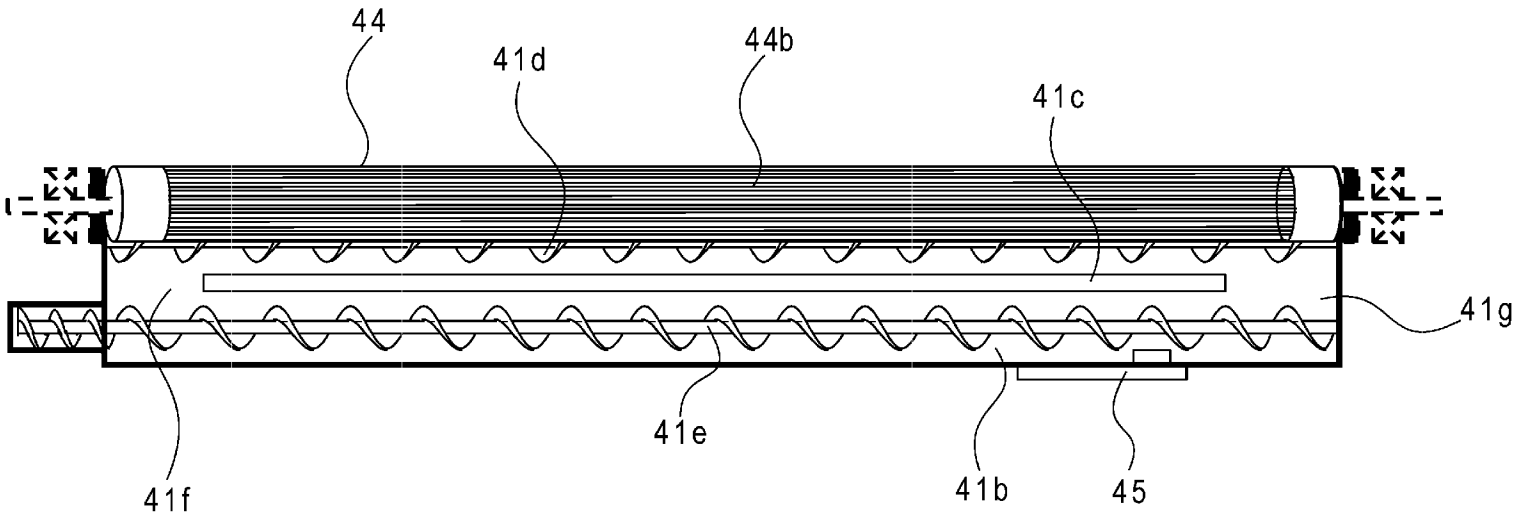
FIG. 3 is a schematic diagram of a developing device of the first embodiment of the present invention.

(Developing device) FIG. 3 is a diagram showing a structure of the developing device 4 according to the present embodiment. As shown in FIGS. 2 and 3, the developing device 4 includes a developer container 41 and a developing sleeve (developer bearing member) 44.

Developer container 41 stores a two-component developer having a non-magnetic toner and a magnetic carrier. The developing container 41 is partitioned into the developing chamber 41*a* and the stirring chamber 41*b* by the partition wall 41*c*. Developer in the developer container 41 is stirred and conveyed by the conveying screws 41*d*, 41*e*, thereby the developer circulates in the developing chamber 41*a* and the stirring chamber 41*b* through the delivery portions 41*f*, 41*g* provided at the end portions in the longitudinal direction of the partition wall 41*c* (left and right in FIG. 3).

The developing sleeve 44 is made of nonmagnetic material. Inside the developing sleeve 44, the magnet roll (magnetic member) 44*a* having a plurality of magnetic poles is fixed along the circumferential direction. A certain amount of the developer in the developing chamber 41*a* is borne on the developing sleeve 44 (the developer bearing member) by the magnetic field generated by the magnet roll 44*a*. Then, while the developing sleeve 44 rotates, the layer thickness of the developer is restricted by the developer regulating member 42 and the restricted developer is conveyed to the developing area facing the photosensitive drum 1.

In the developing area, the developer on the developing sleeve 44 forms a magnetic brush with bristles and supplies toner to the photosensitive drum 1, thereby the electrostatic latent image on the photosensitive drum 1 is developed as a toner image. Developer remaining on the developing sleeve 44 after it has passed through the developing area returns to the developing chamber 41*a* by the further rotation of the developing sleeve 44.

Figure 4:
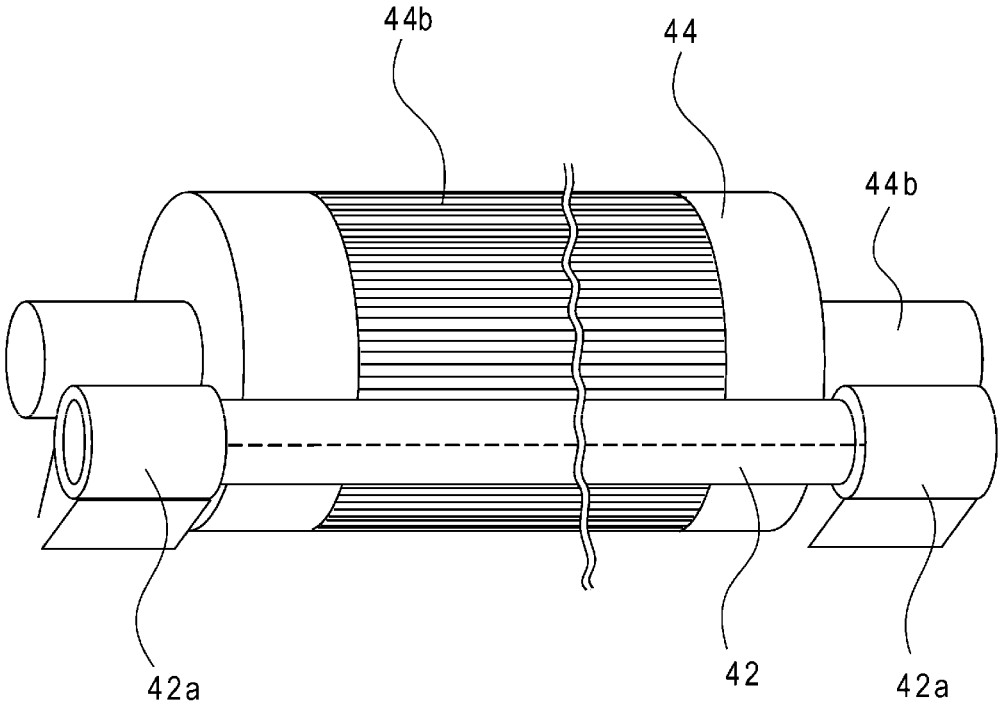
FIG. 4 is a perspective view of the developer bearing member and developer regulating member according to the first embodiment of the present invention.

The developer regulating member 42 is made of magnetic material formed into a cylindrical shape and it is disposed in a position facing the cut-pole N1 of the magnet roll 44*a*. As shown in FIG. 4, both end portions in the longitudinal direction of the developer regulating member 42 are supported by the developer regulating member supporting portions 42*a* which have a hollow cylindrical shape outside the image forming area of the developing sleeve 44.

The developer regulating member 42 is deflected toward the developing sleeve 44 by being attracted to the cut-pole N1. The deflection of the developer regulating member 42 increases in the direction from the both end portions fixed by the developer regulating member supporting portion 42*a* toward the central portion which is not fixed, thereby the S-B-gap (distance between the developing sleeve 44 and the developer regulating member 42) becomes narrower as a position nears the central portion.

As shown in FIGS. 3 and 4, the concave groove 44*b* is formed on the surface of the developing sleeve 44 in a width corresponding to the image forming area. While the developing sleeve 44 rotates with the developer forming a magnetic brush fitted in the groove 44*b*, the developer is conveyed.

M/S (developer weight per unit area) on the developing sleeve 44 is lower as the position nears the central portion which has a narrower S-B gap. When the shape of the groove 44*b* is uniform in the longitudinal direction, the conveying force of the developing sleeve 44 is uniform at any position in the longitudinal direction on the developing sleeve 44. Therefore, deviation in a toner amount to be developed on the photosensitive drum 1 occurs, thereby uneven density of image is produced.

Therefore, in this embodiment, the structure is employed in which the depth of the groove 44*b* becomes deeper in the direction from both end portions to the central portion. With this structure, the conveyance on the surface of the developing sleeve 44 becomes higher as the position nears the central portion, which compensates the reduction of the M/S of the central portion due to the fact that the S-B gap becomes narrower, thereby it is possible to convey the developer uniformly in the longitudinal direction of the developing sleeve 44.

It is preferable that the depth of the groove 44*b* in the longitudinal direction corresponds to the deflection distribution in the longitudinal direction of the developer regulating member 42. In other words, it is preferable that the larger the amount of deflection of the developer regulating member 42 becomes and the narrower S-B gap becomes, the deeper the grooves 44*b* become. The deflection distribution of the developer regulating member 42 is determined based on the magnetic force of the cut-pole N1 of the magnet roll 44*a*, magnetism of developer regulating member 42, the positional relationship, the stiffness and a supporting length of the developer regulating member supporting portion 42*b*. Therefore, the depth and the profile of the shape of the grooves 44*b* are made optimum depending on the configuration described above.

The groove 44*b* of the developing sleeve 44 is formed by etching. First of all, resist is deposited on the mirror portion of the end portions of the developing sleeve 44 and the part to create shallow portions of the groove 44*b* (both end portions). Then, concave grooves are formed at a portion to which the resist is not adhered by being etched by the etchant. This operation is repeated a plurality of times while changing the position of peeling off the resist from the center to the end portion sides. As a result, the groove 44*b* is formed such that it gradually becomes deeper from the edge to the center in the longitudinal direction.

Figure 5A:
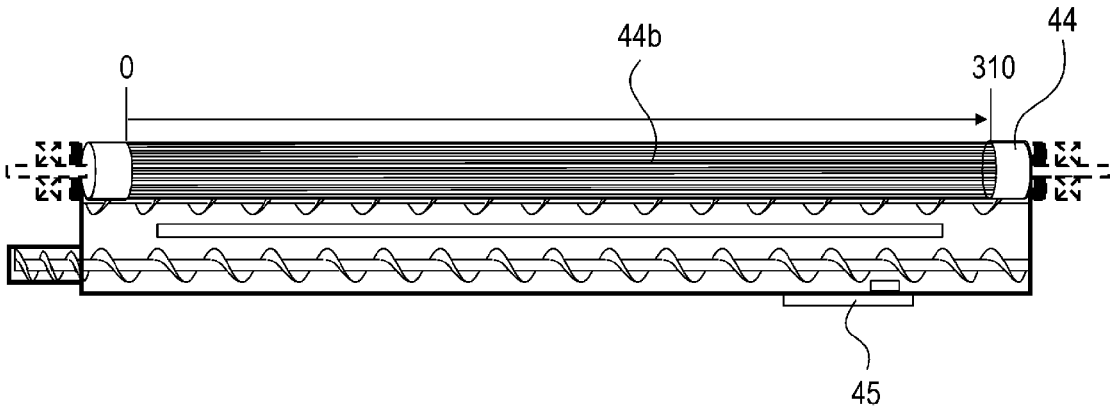
FIG. 5A is a schematic diagram showing a position of the developer bearing member in the longitudinal direction.
Figure 5B:
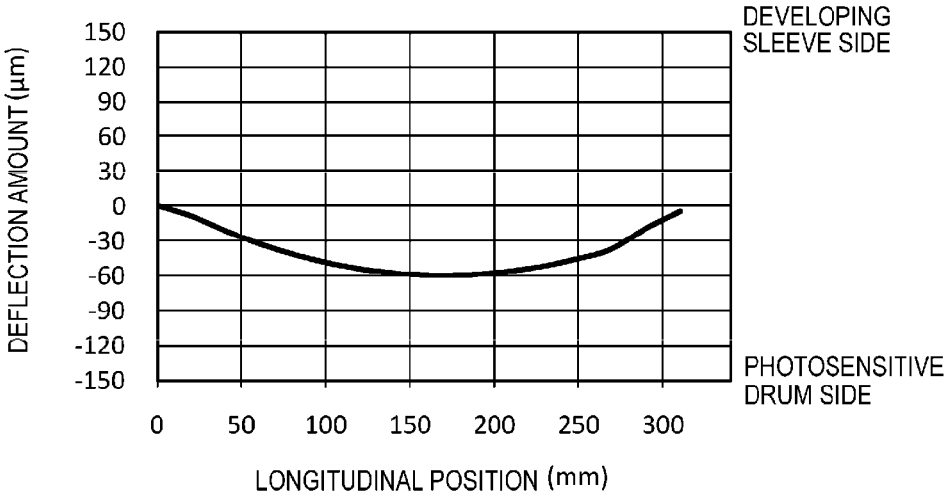
FIG. 5B is a graph showing distribution of amount of deflection of the developer regulating member.
Figure 6A:
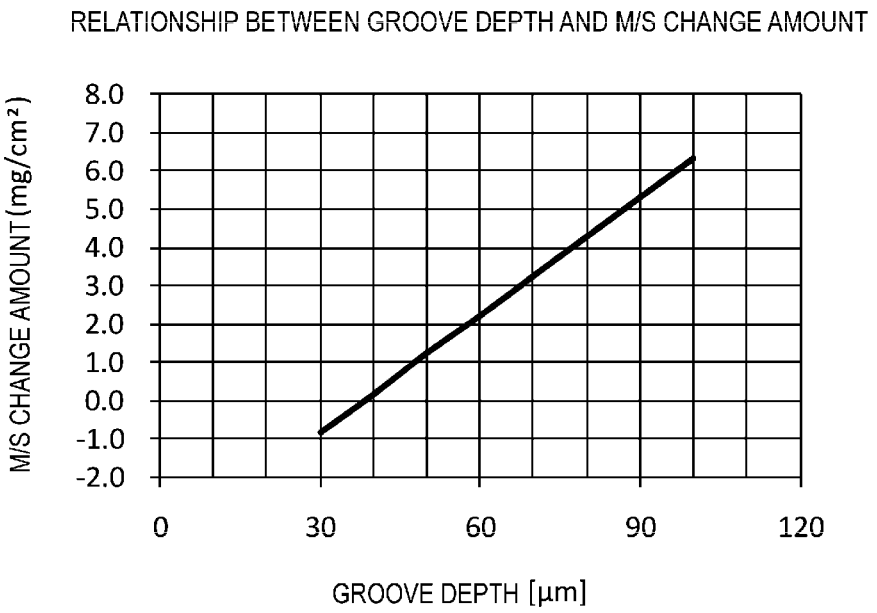
FIG. 6A is a graph showing the relationship between the depth of the groove and an M/S value on the developer bearing member.
Figure 6B:
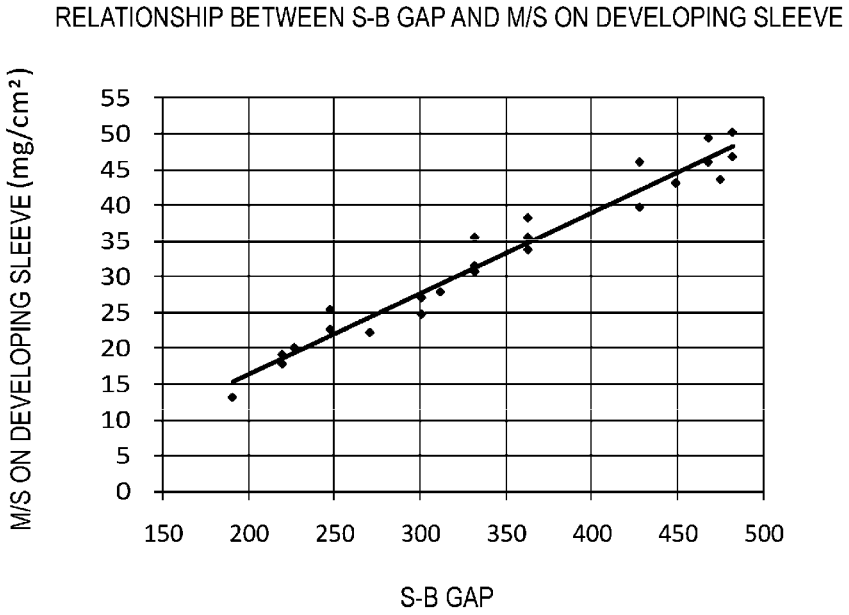
FIG. 6B is a graph showing the relationship between an S-B gap and an M/S value on the developer bearing member.

FIG. 5A is a diagram showing longitudinal positions of the developer regulating member 42. FIG. 5B is a distribution diagram of deflection of the developer regulating member 42. FIG. 6A is a diagram showing the relationship between the depth of the grooves 44*b* and M/S on the developing sleeve 44. FIG. 6B is a diagram showing the relationship between S-B gap and M/S on the developing sleeve 44. In FIGS. 5A, 5B, 6A and 6B, indicated is the case where the developing sleeve 44 of ϕ 20 mm, the developer regulating member 42 having the cylindrical section of ϕ 6 mm are used. Also, magnetic flux density in the normal direction of cut-pole N1 is set to 600 G and the configuration is employed where a peak of magnetic flux density in the normal direction of cut-pole N1 exists on the straight line connecting the center point of the developing sleeve 44 and the center point of the developer regulating member 42.

As shown in FIG. 5B, the amount of deflection of the center portion of the developer regulating member 42 is 60 μm. When the S-B gap at end portions of width of the image forming is set to 320 μm and M/S=30 mg/cm$^2$, S-B gap of the central portion is set to 260 μm and M/S=23 mg/cm$^2$. With the use of FIGS. 5B, 6A and 6B, the relationship between deflection of the developer regulating member 42 and depth of the grooves 44*b* for making uniform M/S on the developing sleeve 44 in the longitudinal direction is understood.

When the depth of the groove 44*b* of the end portions of the developing sleeve 44 is set to 40 μm and M/S=30 mg/cm$^2$, the depth of the groove 44*b* near the closest part of S-B gap (the center of the developing sleeve 44) is 100 μm. With the configuration that the depth of the groove 44*b* of the central portion is 100 μm, M/S increases in an amount of a little more than 6 mg/cm$^2$ as compared with the case where the depth is 40 μm. Thus, even if S-B gap is narrowed at the central portion, M/S of the central portion can be raised 29 mg/cm$^2$, which is equivalent to the value of the end portions.

M/S on the developing sleeve 44 falls in the range of 29-32 mg/cm$^2$ at any position in the longitudinal direction and is substantially uniform. Therefore, by optimizing the depth of the groove 44*b* on the surface of the developing sleeve 44 according to the amount of deflection of the developer regulating member 42 and S-B gap, it is possible to improve the density unevenness. That is, even if the developer regulating member 42 is attracted to the magnet roll 44*a* and S-B gap is narrowed, it is possible to suppress the density unevenness of an output image.

The developing sleeve 44 with the groove 44*b* has high durability as compared with the developing sleeve using the blasting system. Therefore, it is possible to suppress degradation of conveying performance due to rubbing of developer and the developing sleeve 44, thereby a high-quality image free from density unevenness over a long period can be provided.

In the present invention, the shape of the groove is configured such that at least one piece of carriers can be caught by the groove. That is, the width of the recess of the groove is larger than the diameter of the carrier particle and the depth of the recess of the groove is larger than the diameter of the carrier particle. With this configuration, conveying force can be obtained. In this embodiment, in addition to meeting the above condition of the shape of the groove, the depth of the groove is changed such that different conveying forces are obtained at the end portions and the central portion of the developing sleeve 44.

Second Embodiment

Figure 7:
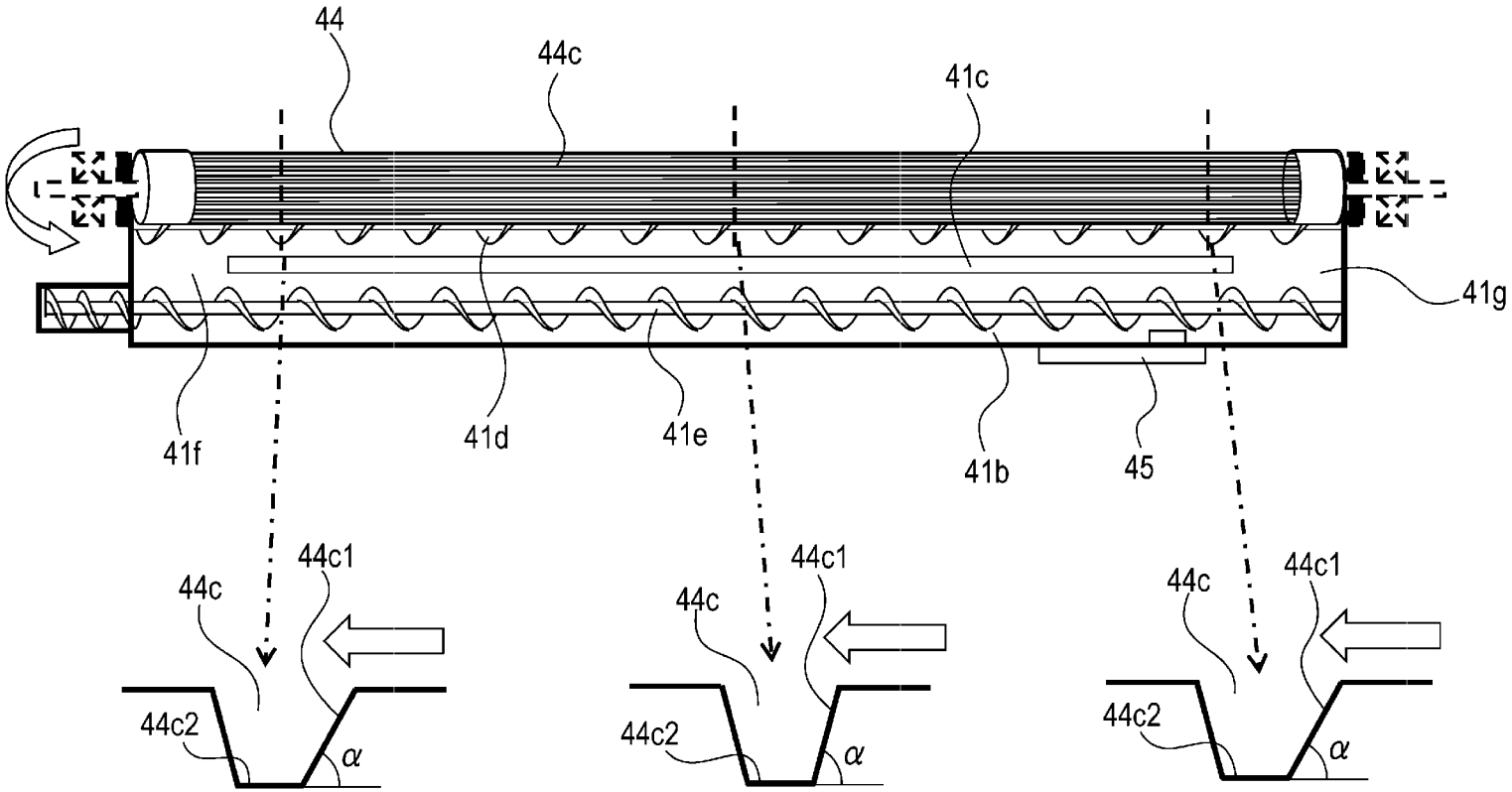
FIG. 7 is a schematic diagram of the developer bearing member according to the second embodiment of the present invention.

Next, the second embodiment of a developing device and an image forming apparatus according to the present invention will be described with reference to FIGS. 7 and 8. For the overlapping parts of the description with the first embodiment, the description thereof is omitted with the same reference numerals. FIG. 7 is a diagram showing a structure of the developing sleeve 44 of this embodiment.

As shown in FIG. 7, the groove 44*c* is provided on the developing sleeve 44 of the present embodiment, instead of the groove 44*b* provided on the developing sleeve 44 of the first embodiment. The groove wall angle α of the groove wall surface 44*c*1 on the upstream side in a rotating direction with respect to the groove bottom surface 44*c*2 becomes smaller as a position of the groove 44*c* nears the both end portions in a longitudinal direction, and the groove wall angle α becomes larger as a position of the groove 44*c* nears the central portion in a longitudinal direction.

By reducing the angle α of the groove wall surface 44*c*1 of the upstream side in the rotating direction, it is possible to reduce the force (conveying force) in the circumferential direction, which acts on the magnetic brush by the rotation of the developing sleeve 44. That is, the depth of the groove 44*b* is changed in the first embodiment, however, in this embodiment, the angle α of the groove 44*c* is changed instead for achieving uniform conveyance amount of developer in the longitudinal direction.

Figure 8:
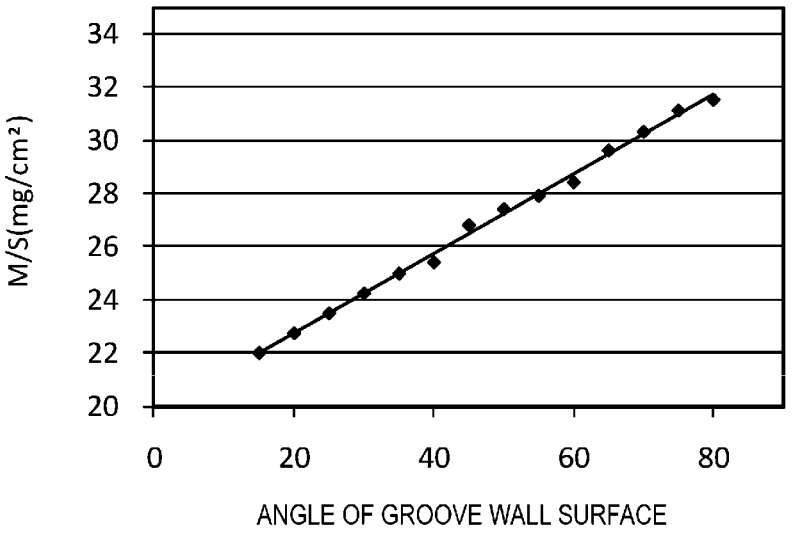
FIG. 8 is a graph showing an angle of groove wall surface and M/S value during conveyance.

FIG. 8 is a graph showing the relationship between M/S values and angles α when developer is conveyed with an angle α of the groove wall surface 44*c*1. The angle α of the central portion from the longitudinal position 100 mm to 250 mm is set to 70 degrees, the M/S value is set around 30 mg/cm$^2$. The angle α of the end portion from the longitudinal position 0 mm to 40 mm is set to 40 degrees, the angle α of the portion from the longitudinal position 40 mm to 100 mm is set to 60 degrees, the angle α of the portion from the longitudinal 250 mm to 280 mm is set to 60 degrees, and the angle α of the end portion from the longitudinal position 280 mm to 310 mm is set to 40 degrees.

As explained above, by providing differences in the conveying force in the longitudinal direction of the developing sleeve 44, M/S values on the developing sleeve 44 fall in the range of 27.5 to 31.5 mg/cm$^2$ in the entire longitudinal positions, which is substantially uniform. Thus, by optimizing the angle α of the groove wall surface 44*c*1 of the upstream side in the rotating direction, it is possible to improve density unevenness.

The groove 44*c* is formed by etching. By performing etching a plurality of times while gradually retracting the mask at the upstream side in the rotational direction, the angles α are made such that the groove wall 44*c*1 becomes fine stepwise shape.

Third Embodiment

Figure 9:
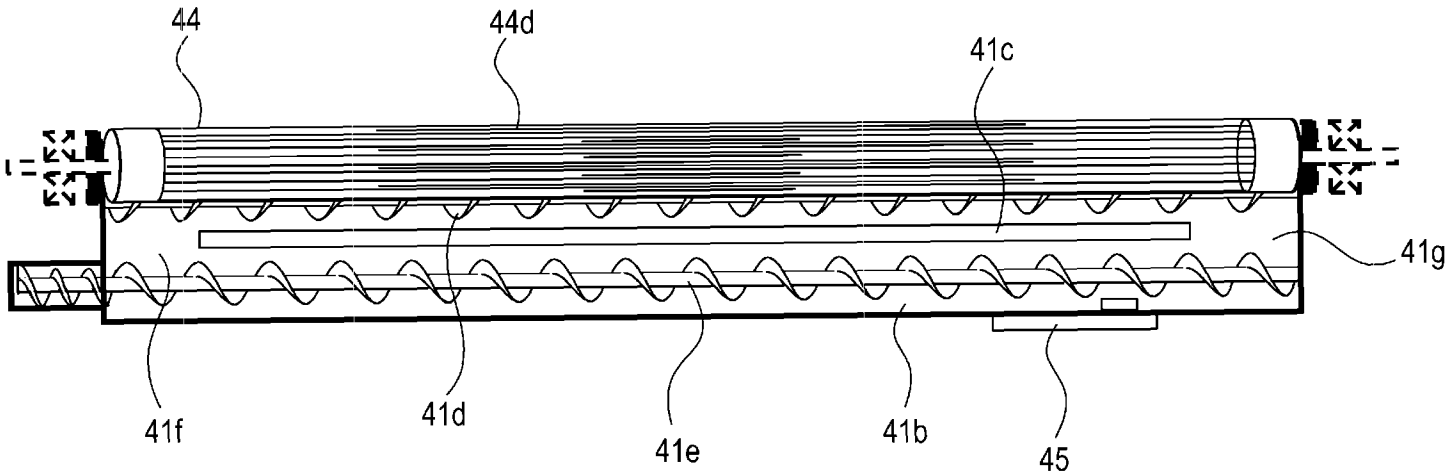
FIG. 9 is a schematic diagram of the developer bearing member according to the third embodiment of the present invention.

Next, the third embodiment of a developing device and an image forming apparatus according to the present invention will be explained with reference to FIGS. 9 and 10. For the overlapping parts of the description with the first embodiment, the description thereof is omitted with the same reference numerals. FIG. 9 is a diagram showing the configuration of the developing sleeve 44 of this embodiment.

As shown in FIG. 9, the grooves 44*d* are provided on the developing sleeve 44 of this embodiment, instead of the grooves 44*b* provided on the developing sleeve 44 of the first embodiment. The grooves 44*d* are arranged such that more grooves are provided as the position nears the center portion in the longitudinal direction. That is, the distance between the grooves 44*d* on the developing sleeve 44 in the circumferential direction becomes narrower as the position nears the center portion in the longitudinal direction.

Figure 10:
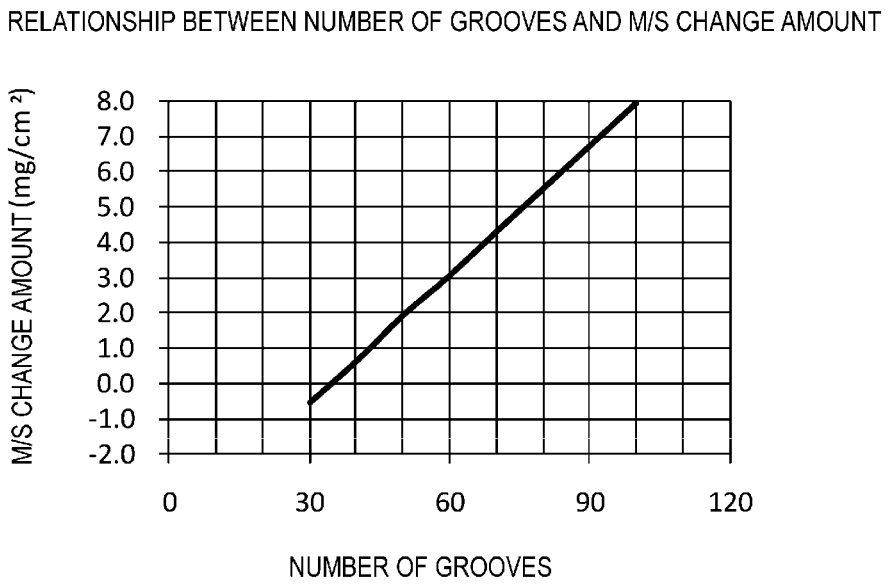
FIG. 10 is a graph showing a number of grooves and M/S value during conveyance.

FIG. 10 is a graph showing the relationship between numbers of grooves 44*d* and M/S values when developer is conveyed with a number of the grooves 44*d*. In this embodiment, the lengths of the grooves 44*d* which extend from the center portion to the end portion are divided into three groups. More grooves 44*d* per one round of periphery of the developing sleeve 44 are provided as a position of the sleeve 44 is closer to the center portion and less grooves 44*d* per one round of periphery of the developing sleeve 44 are provided as a position of the sleeve 44 is closer to the end portion in accordance with a distance from the center. Thus, the number of the grooves 44*d* of the central portion is three times as large as that of the end portion, thereby higher transportation force can be obtained at the center portion.

Specifically, the number of grooves 44*d* from the longitudinal position 0 mm to 30 mm is 30 per a round of periphery, the number of grooves 44*d* from the longitudinal position 30 mm to 80 mm is 60 per a round of periphery, the number of grooves 44*d* of the central portion from the longitudinal position 80 mm to 270 mm is 90 per a round of periphery, the number of grooves 44*d* from the longitudinal position 270 mm to 290 mm is 60 per a round of periphery, and the number of grooves 44*d* from the longitudinal position 290 mm to 310 mm is 30 per a round of periphery. The reason why it is not symmetrical in the longitudinal direction is that the number of grooves 44*d* is optimized in accordance with the amount of deflection of the developer regulating member 42 and an S-B gap.

Thus, M/S irregularity on the developing sleeve 44 falls in the range of 28 mg/cm$^2$ to 31.5 mg/cm$^2$, which is substantially uniform. As explained above, it is possible to improve density unevenness by optimizing the number of the grooves 44*d* in accordance with the deflection of the developer regulating member 42 and an S-B gap.

Fourth Embodiment

Figure 11:
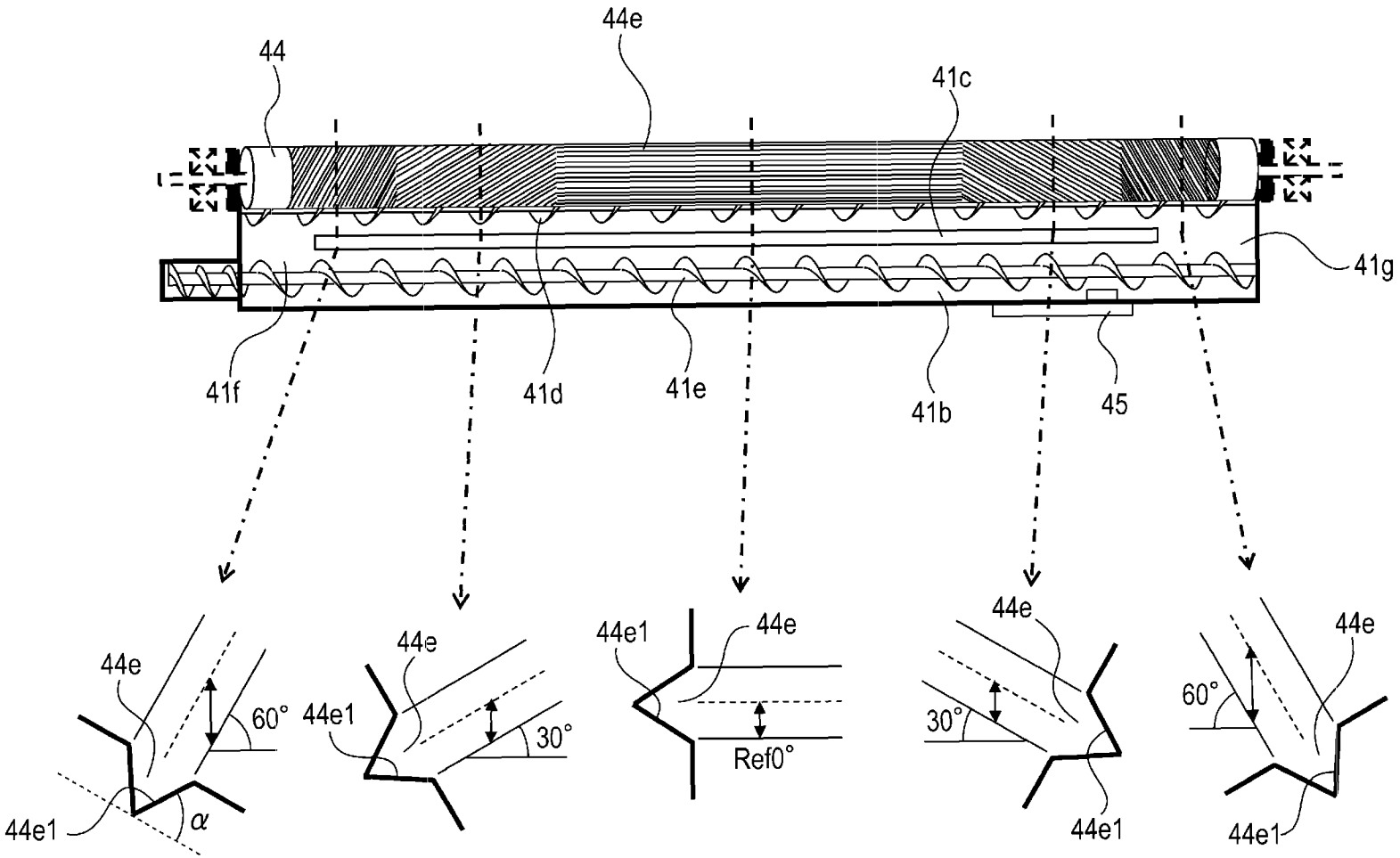
FIG. 11 is a schematic diagram of the developer bearing member according to the fourth embodiment of the present invention.

Next, the fourth embodiment of a developing device and an image forming apparatus according to the present invention will be explained with reference to FIGS. 11 and 12. For the overlapping parts of the description with the first embodiment, the description thereof is omitted with the same reference numerals. FIG. 11 is a diagram showing the configuration of the developing sleeve 44 of this embodiment.

As shown in FIG. 11, the grooves 44*e* are provided on the developing sleeve 44 of this embodiment, instead of the grooves 44*b* provided on the developing sleeve 44 of the first embodiment. The grooves 44*e* of the central portion of the sleeve 34 in the longitudinal direction are formed in parallel to the axis (the longitudinal direction) of rotation of the developing sleeve 44. In addition, the grooves 44*e* are formed such that the grooves 44*e* are more inclined stepwise toward the down stream side of the developer conveying direction as they near the end portions.

Thus, by changing the angle formed by the axial direction of the developing sleeve 44 and the grooves 44*e*, the angle of groove wall surface 44*e*1 in the circumferential direction is changed similarly to the second embodiment. With this configuration, conveying force in the circumferential direction can be changed, thereby uniform conveying amount of developer in the longitudinal direction can be achieved.

In this embodiment, the developing sleeve 44 has ϕ 20 mm, the developer regulating member 42 has ϕ 6 mm, and the cut pole N1 has normal magnetic flux density of 550 G. The configuration is employed where a peak of magnetic flux density in the normal direction of cut-pole N1 exists on the straight line connecting the center point of the developing sleeve 44 and the center point of the developer regulating member 42. In addition, the grooves 44*e* is V-shaped with depth of 50 μm and the groove wall surface angle α of the groove wall surface 44*e*1 of 45 degrees.

The angle formed by the grooves 44*e* and the rotational axis (longitudinal direction) at the end portion from the longitudinal position 0 mm to 40 mm is 60 degrees, that at the portion from the longitudinal position 40 mm to 100 mm is 30 degrees, that at the central portion from the longitudinal position 100 mm to 250 mm is 0 degrees (parallel to the rotational axis), that at the portion from the longitudinal position 250 mm to 290 mm is 30 degrees, that at the portion from the longitudinal position 290 mm to 310 mm is 60 degrees. The reason why it is not symmetrical in the longitudinal direction is that the angle formed by the grooves 44*e* and the rotational axis (longitudinal direction) is optimized in accordance with the amount of deflection of the developer regulating member 42 and an S-B gap.

Figure 12:
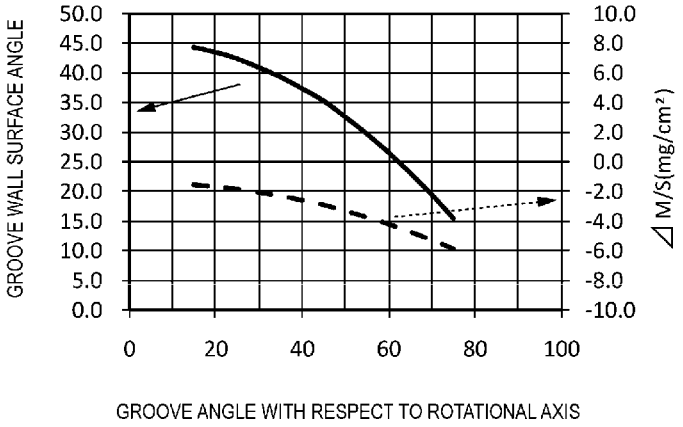
FIG. 12 is a graph showing changes in M/S values with respect to angles (dotted line) formed by the rotational axis and the grooves, and with respect to the angles (solid line) of the groove wall surface, according to the fourth embodiment of the present invention.

FIG. 12 is a graph showing changes in M/S values with respect to angles (dotted line) formed by the rotational axis and the grooves 44*e*, and with respect to the angles α (solid line) of the groove wall surface 44*e*1. When M/S value is set to about 28 mg/cm$^2$ at 0 degrees of the angle of the grooves 44*e* with respect to the rotational axis, approximately uniform M/S distribution can be obtained by setting the above angles.

In this case, M/S irregularity on the developing sleeve 44 in the longitudinal direction falls in the range of 28.0 mg/cm$^2$ to 30.5 mg/cm$^2$. Therefore, the density unevenness is improved by optimizing the groove depth of the surface of the developing sleeve 44 in accordance with amount of deflection of the developer regulating member 42, that is, an S-B gap.

In the first to third embodiments described above, the grooves are formed by etching, however, in this embodiment, the grooves 44*e* are formed by pultrusion molding or extrusion molding. First, a blade to form a V-shaped groove is inserted to a pultrusion mold disposed on the circumference while rotating an aluminum cylindrical base pipe of ϕ 20 mm (developing sleeve base tube). Then, only the rotation is stopped in the vicinity of the central portion. After that, the blade is pulled out toward another end portion while rotating in a reverse direction of the insertion. Then, in order to scrape off the grooves at both ends of the cylindrical base pipe, where it is not necessary to have developer conveying capacity, a mirror-finish is performed by grinding 15 mm of the both ends in about 80 μm to 100 μm depth using a polishing apparatus.

According to the present invention, even if the developer regulating member is attracted to the magnet member, and the distance between the developing sleeve and the developer regulating member becomes smaller, it is possible to suppress the density unevenness of an output image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-019312, filed Feb. 4, 2014 which is hereby incorporated by reference herein in its entirety.

What is claimed is:

1. A developing device, comprising:

a developer bearing member which bears a two-component developer including a toner and carrier;

a magnet member disposed inside the developer bearing member, the magnet member making the developer bearing member bear the two-component developer on the developer bearing member by magnetic force; and a developer regulating member which regulates a layer thickness of the developer borne on the developer bearing member, the developer regulating member being made of magnetic material, the developer regulating member being fixed at both end portions in a longitudinal direction, wherein grooves are formed on a surface of the developer bearing member, and a developer conveying force of the grooves at a central portion of the developer bearing member in the longitudinal direction is larger than a developer conveying force of the grooves at an end portion of the developer bearing member in the longitudinal direction.

2. The developing device according to claim 1, wherein the grooves are shaped such that a developer conveying force of the grooves becomes larger as a position of the developer bearing member in the longitudinal direction is closer to a central portion of the developing bearing member in the longitudinal direction.

3. The developing device according to claim 2, wherein a depth of the grooves becomes deeper as a position of the developer bearing member in the longitudinal direction is closer to the central portion of the developer bearing member.

4. The developing device according to claim 3, wherein a width of the grooves is larger than a diameter of one particle of carrier of the developer and the depth of the grooves is larger than the diameter.

5. An image forming apparatus, comprising:

an image bearing member which bears an electrostatic latent image; and the developing device according to claim 4, the developing device developing the electrostatic latent image borne on the image bearing member.

6. An image forming apparatus, comprising:

an image bearing member which bears an electrostatic latent image; and the developing device according to claim 3, the developing device developing the electrostatic latent image borne on the image bearing member.

7. The developing device according to claim 2, wherein an angle of a groove wall surface at an upstream side in a rotational direction of the grooves becomes larger as a position of the developer bearing member in the longitudinal direction is closer to the central portion of the developer bearing member.

8. The developing device according to claim 7, wherein a width of the grooves is larger than a diameter of one particle of carrier of the developer and a depth of the grooves is larger than the diameter.

9. An image forming apparatus, comprising:

an image bearing member which bears an electrostatic latent image; and the developing device according to claim 8, the developing device developing the electrostatic latent image borne on the image bearing member.

10. An image forming apparatus, comprising:

an image bearing member which bears an electrostatic latent image; and the developing device according to claim 7, the developing device developing the electrostatic latent image borne on the image bearing member.

11. The developing device according to claim 2, wherein a number of the grooves becomes more as a position of the developer bearing member in the longitudinal direction is closer to the central portion of the developer bearing member.

12. The developing device according to claim 11, wherein a width of the grooves is larger than a diameter of one particle of carrier of the developer and a depth of the grooves is larger than the diameter.

13. An image forming apparatus, comprising:

an image bearing member which bears an electrostatic latent image; and the developing device according to claim 12, the developing device developing the electrostatic latent image borne on the image bearing member.

14. An image forming apparatus, comprising:

an image bearing member which bears an electrostatic latent image; and the developing device according to claim 11, the developing device developing the electrostatic latent image borne on the image bearing member.

15. The developing device according to claim 2, wherein the grooves are formed in parallel with the longitudinal direction at the central portion of the developer bearing member in the longitudinal direction, and inclined more with the longitudinal direction as a position of the developer bearing member in the longitudinal direction is closer to an end portion.

16. The developing device according to claim 15, wherein a width of the grooves is larger than a diameter of one particle of carrier of the developer and a depth of the grooves is larger than the diameter.

17. An image forming apparatus, comprising:

an image bearing member which bears an electrostatic latent image; and the developing device according to claim 16, the developing device developing the electrostatic latent image borne on the image bearing member.

18. An image forming apparatus, comprising:

an image bearing member which bears an electrostatic latent image; and the developing device according to claim 15, the developing device developing the electrostatic latent image borne on the image bearing member.

19. The developing device according to claim 2, wherein a width of the grooves is larger than a diameter of one particle of carrier of the developer and a depth of the grooves is larger than the diameter.

20. An image forming apparatus, comprising:

an image bearing member which bears an electrostatic latent image; and the developing device according to claim 19, the developing device developing the electrostatic latent image borne on the image bearing member.

21. An image forming apparatus, comprising:

an image bearing member which bears an electrostatic latent image; and the developing device according to claim 2, the developing device developing the electrostatic latent image borne on the image bearing member.

22. The developing device according to claim 1, wherein a width of the grooves is larger than a diameter of one particle of carrier of the developer and a depth of grooves is larger than the diameter.

23. An image forming apparatus, comprising:

an image bearing member which bears an electrostatic latent image; and the developing device according to claim 22, the developing device developing the electrostatic latent image borne on the image bearing member.

24. An image forming apparatus, comprising:

an image bearing member which bears an electrostatic latent image; and the developing device according to claim 1, the developing device developing the electrostatic latent image borne on the image bearing member.

* * * * *